250-506.1 SR
3/18/86 OR 4,577,112

United States Patent [19]
Conche et al.

[11] Patent Number: 4,577,112
[45] Date of Patent: Mar. 18, 1986

[54] MOVABLE ENCLOSURE FOR THE REPLACEMENT AND TRANSPORTATION OF CONTAMINATED PARTS AND COMPLEMENTARY CASING FOR SUCH AN ENCLOSURE

[75] Inventors: François Conche, Les Mureaux; Jean-François Montret, Verriere Le Buisson, both of France

[73] Assignee: Commissariat a l'Energie Atomique, Paris, France

[21] Appl. No.: 597,042

[22] Filed: Apr. 5, 1984

[30] Foreign Application Priority Data

Apr. 13, 1983 [FR] France ..... 83 06028

[51] Int. Cl.[4] ..... G21F 5/00
[52] U.S. Cl. ..... 250/506.1
[58] Field of Search ..... 250/506, 507, 515; 376/272

[56] References Cited

U.S. PATENT DOCUMENTS

| | | | |
|---|---|---|---|
| 2,514,909 | 7/1950 | Strickland | 250/507 |
| 3,483,380 | 12/1969 | Antonsen et al. | 376/272 |
| 4,149,087 | 4/1979 | Artemiev et al. | 376/272 |

FOREIGN PATENT DOCUMENTS

| | | | |
|---|---|---|---|
| 1294799 | 4/1962 | France . | |
| 1386374 | 12/1963 | France . | |
| 1355690 | 2/1964 | France . | |
| 1465779 | 12/1965 | France . | |
| 1586456 | 2/1970 | France . | |
| 2145361 | 2/1973 | France . | |
| 0156650 | 9/1982 | German Democratic Rep. | 250/506.1 |

*Primary Examiner*—Bruce C. Anderson
*Assistant Examiner*—Paul A. Guss
*Attorney, Agent, or Firm*—James E. Nilles

[57] ABSTRACT

The invention relates to a movable enclosure for the replacement and transportation of contaminated parts, as well as to a complementary confinement casing. The enclosure comprises a confinement body in which is received a cylinder having at least two cavities. Each cavity contains a gripping head, which can be introduced into an opening of the body and intended to be tightly arranged in the extension of the housing of a part to be replaced. The locking of the part onto the head is obtained by manipulating a pull handle located in the handling rod and used for displacement of each gripping head in its cavity. Application to interventions on nuclear installations located in confinement cells.

8 Claims, 13 Drawing Figures

MOVABLE ENCLOSURE FOR THE REPLACEMENT AND TRANSPORTATION OF CONTAMINATED PARTS AND COMPLEMENTARY CASING FOR SUCH AN ENCLOSURE

BACKGROUND OF THE INVENTION

The present invention relates to a movable enclosure for the replacement of contaminated equipment, as well as for the transportation of the same to a discharge unit, where they can undergo appropriate treatments or repairs. The invention also relates to a complementary confinement casing or sheath for such an enclosure.

It is known that installations for the analysis and treatment of radioactive materials must be located in completely tight confinement cells. Therefore, these installations must be remotely controlled from the outside of the cell and any handling operation involves the performance of a precise intervention process leading to no break in the seal of the cell.

In particular, when the maintenance of such an installation requires the replacement of a mechanical part, it is necessary to remove the latter from the cell. The intervention process must then enable this operation to take place, whilst protecting the personnel present at all times. This presupposes that the cell seal is at no time broken and that the contaminated part is never in direct contact with the ambient air when it is removed from the cell.

At present, this type of operation is carried out by means of flexible plastic material sacks or bags (generally polyvinyl chloride) in which the part is enveloped during its removal from the cell and which simultaneously maintain the seal of the latter. The thus enveloped part is introduced into a transportation casket or container and the tight seal of the plastic material bag is brought about by means of a double system of slide valves respectively connected to the cell and to the casket and effecting the weld of the plastic bag. Such a system is described in the reports of the 13th Conference of the American Nuclear Society of 15–18 Nov. 1965 at Washington, pp. 118/9, article by J. A. Evans entitled "Transfer device for irradiated materials".

The description of the operation given in this document makes it clear that such a process takes a long time and makes it necessary to equip the confinement cells with special equipment. Moreover, the opening of the tightly sealed bag at the discharge unit is necessarily accompanied by a break in the confinement, which is obviously not satisfactory from the standpoint of the safety or personnel.

In addition, the use of the conventional intervention procedure requires numerous manipulation and transportation operations. Thus, it is firstly necessary to bring the empty casket from the discharge unit to the cell in which the part to be replaced is located and then the latter has to be transferred from the cell to the casket using a process comparable to that described in the aforementioned publication. The casket containing the part then has to be transported to the discharge unit, where the part is removed from the casket. A casket containing a new part is then transported up to the cell and the new part is transferred into the latter. Finally, the casket containing the defective, contaminated equipment is brought to the discharge unit. It can be seen that this takes a relatively long time, which is not really compatible with the operating conditions imposed on such installations.

It is also clear that the number of transportation operations relative to the contaminated equipment leads to an increase in the risks of accidents. From this standpoint, it should also be noted that the method consisting of packaging contaminated parts in flexible plastic bags offers the supplementary risks of these bags tearing during transportation as a result of a shock or impact, which would lead to a complete loss of their effectiveness.

SUMMARY OF THE INVENTION

The present invention relates to a movable enclosure making it possible to solve all the aforementioned disadvantages of the presently used transportation procedure. More specifically, the movable enclosure according to the invention makes it possible to eliminate the tight plastic bags and to limit the number of transporation operations which have to be carried out because, as will be shown hereinafter, the enclosure according to the invention makes it possible during a single outward and return transportation operation to bring in a new part and remove the contaminated part. It is obvious that these two features lead to a considerable simplification of the intervention procedure, which leads to much greater reliability and safety with respect to the removal of contaminated equipment than those provided by the use of the prior art procedure. As the number of contaminated equipment transportation operations is reduced by a third, the risks of accidents are, at a minimum, reduced by the same proportion.

The present invention therefore relates to a movable enclosure for the replacement and transportation of contaminated parts, comprising a tight biological protection body within which is arranged a drum or cylinder having at least two cylindrical cavities respectively able to receive a new part and a contaminated part, means for rotating the drum or cylinder within the body, so as to bring each of the cavities in turn in front of an opening with the same diameter formed in the body, a gripping head slidingly mounted in each cavity, means for displacing said head between a rear equipment storage position and a forward intervention position in which the gripping head penetrates the said opening, and means for the remote control of the gripping head able to lock the latter onto the part to be replaced.

According to a particularly avantageous embodiment of the invention, the drum or cylinder has a third cavity in which is located an intervention tool, the latter term in this case covering both an observation or inspection instrument and a gripping head able to provisionally grasp a plug giving access to the part to be removed, or an actual intervention tool.

According to a preferred embodiment of the invention, each gripping head is in the form of a piston, the means for displacing the head incorporating an actuating rod connecting each gripping head to the exterior of the body along the axis of the corresponding cavity, a rack being formed on each actuating rod and meshing on a pinion carried by the body when the corresponding cavity faces said opening, said pinion being rotatable by appropriate means.

In this case, the body can also have a cover fixed to the rotating cylinder, a cylindrical part in which the cylinder is located, and a base in which is formed the opening, each actuating rod passing through the cover via passages arranged coaxially to the cavities.

In order to permit the replacement of the cylinder when it has been used a large number of times, the body is preferably made in three detachable parts essentially corresponding to the cover, the cylindrical part and the base , in such a way that the cylinder can be changed following the detachment of the cover and the cylindrical part.

In order to protect against contamination of those parts of the movable enclosure which can pass into the open air during certain manipulations, each gripping head can be connected to the cover by a sealing bellows surrounding the corresponding actuating rod.

According to another feature of the invention, each actuaing rod is hollow, so that the remote control means of each gripping rod incorporates a central pull handle which can be introduced into the rod in order to radially force back by its end at least one movable finger located in the gripping head in a recess provided for this purpose in the part to be replaced or in a gripping part integral therewith.

The central pull handle then preferably has a threaded part which can be screwed into a tapping of each gripping head, the outer end of the pull handle being rotatable by appropriate means.

According to yet another feature of the invention, each gripping head closes the opening in a tight manner when occupying said forward position, so as to ensure the sealing of the body during the transportation of the enclosure.

The movable enclosure can also comprise a plug which can be joined to the body and can partly penetrate the opening during the transportation of the enclosure.

Preferably, a pressure balancing circuit is also provided to facilitate the introduction of the new part into its cell or the introduction of the contaminated part into an appropriate casing or sheath. This circuit comprises a duct connecting the opening to the interior of cavities through at least one filter. A pumping circuit can also be provided and incorporates a duct connecting the internal volume of the cavities to the outside across at least three filters and having a common part with the balancing circuit.

The invention also relates to a casing for confining the contaminated parts and which is complementary to the aforementioned movable enclosure. This casing comprises a slot able to extend the opening formed in the body of the movable enclosure, when the casing is associated therewith and able to cooperate tightly with at least one bushing integral with the contaminated part, as well as a detachable cover.

BRIEF DESCRIPTION OF THE DRAWINGS

The invention is described in greater detail hereinafter relative to non-limitative embodiments and with reference to the attached drawings, wherein.

DETAILED DESCRIPTION OF THE INVENTION

Figure 1:
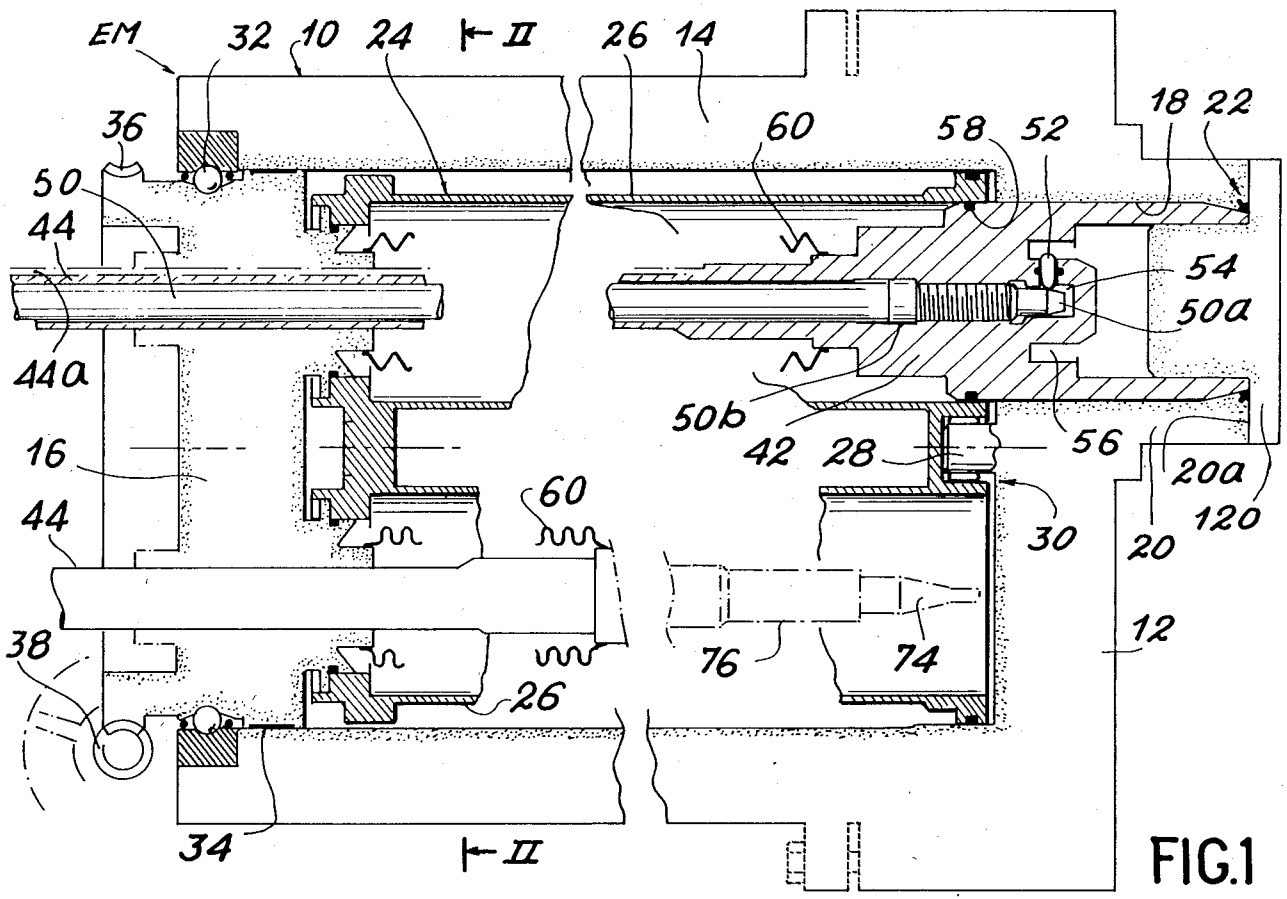
FIG. 1 is a diagrammatic longitudinal sectional view, with an interruption in part of its length, of a movable enclosure constructed according to the invention.
Figure 2:
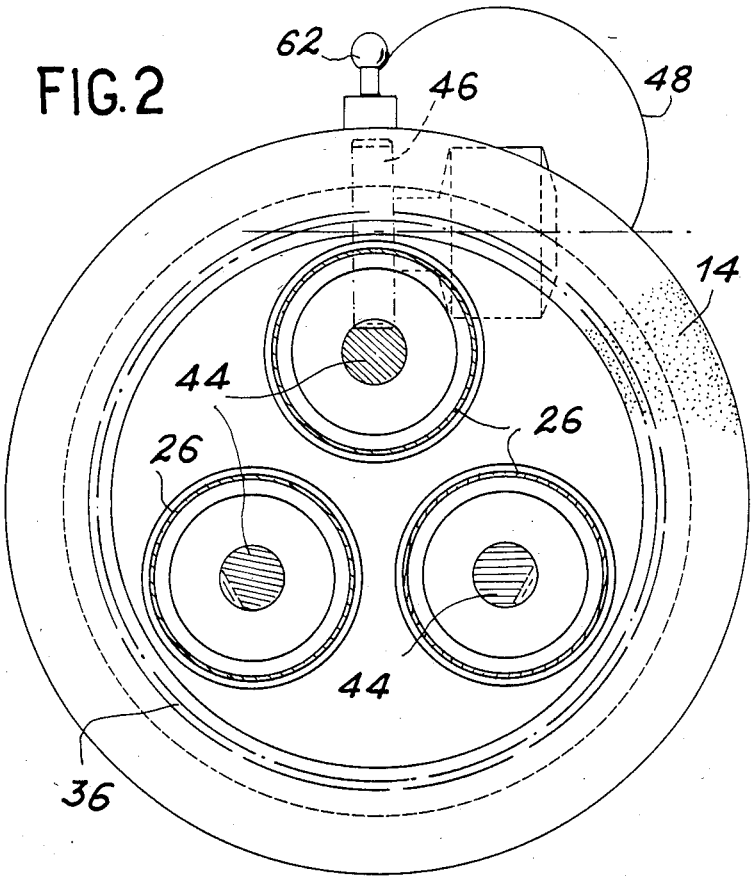
FIG. 2 is a side view in section along line II—II of FIG. 1, more particularly showing the three cavities of the movable enclosure.

As is more particularly illustrated in FIGS. 1 and 2, the movable enclosure EM according to the invention comprises a cylindrical body 10 for ensuring the biological protection of the personnel against contaminated parts transported in the enclosure. Therefore, body 10 is preferably formed from lead sheathed in stainless steel and has a minimum lead thickness of 50 mm. This body, which can be dismantled or detached in the manner shown hereinafter, must be perfectly tight.

The enclosure body 10 has a base 12, a cylindrical part 14 and a cover 16. Base 12 has an eccentric cylindrical opening 18 through which the parts are transferred. The base 12 of the body has a cylindrical part 20, which projects to the outside around opening 18. The end of part 20 defines an engagement surface 20*a* by which the movable enclosure can come into tight contact with a wall of the cell containing the part to be replaced. For this purpose, on said surface, around opening 18, is provided a triple action joint 22.

Within body 10, the movable enclosure contains a drum or cylinder 24 preferably having three identical cavities (FIG. 2) arranged at 120° from one another and each constituted by a cylindrical tube, whose internal diameter is equal to the internal diameter of opening 18.

As is more particularly illustrated by FIG. 1, cylinder 24 is integral with the cover 16 of the body and is mounted so as to rotate within the cylindrical part 14 thereof. Therefore, body base 12 has along the axis thereof a pivot pin 28, about which is mounted the cylinder by means of a roller bearing 30. At the other end of the enclosure, cover 16 is mounted in rotary manner in cylindrical part 14 via a ball bearing 32.

The tightness of body 10 between cover 16 and cylindrical part 14 is preserved e.g. at a rotary joint 34, positioned alongside bearing 32.

In the represented embodiment, the rotation of cylinder 24 is controlled by means of the body cover 16. To this end, as is more particularly illustrated in FIGS. 1 and 3, cover 16 has a toothed ring or rim 36, located to the rear of the end of the cylindrical part 14 and on which is engaged a pinion 38 integral with an operating hand wheel 40. The common shaft of pinion 38 and hand wheel 40 is mounted tangentially to ring 36 in a part fixed to the end of cylindrical part 14 of the enclosure body.

By construction, the distance between the rotation axis of cylinder 24 and the axis of opening 18 is the same as the distance between the rotation axis of the cylinder and the axes of each of the cavities 26. Thus, the operation of the hand wheel 40 makes it possible to bring each of the cavities 26 successively in front of opening 18.

The movable enclosure according to the invention also comprises, in at least two of the cavities 26, a gripping head 42 constituted by a specially shaped piston, which can freely slide within its cavity, as well as in opening 18 on facing the latter. In the latter position shown in FIG. 1, it can be seen that the gripping head 42 then fulfils the supplementary function of a sealing means for the enclosure body 10. To this end, the outer end of opening 18, as well as the corresponding end of each of the gripping heads 42 has a truncated cone shape, so that they have a reduced diameter at surfaces 20*a*. Thus, a good seal is obtained between part 20 and head 42.

The displacement of each of the gripping heads 42 within its cavity is controlled by an actuating rod 44, fixed to the corresponding gripping head in such a way as to be integral therewith. The actuating rods 44 are constituted by hollow rods disposed along the axes of the cavities. These rods pass through the body cover 16 and each has a rack 44*a* (FIG. 3) for controlling its displacement along the axis of the corresponding cavity. Therefore, it is possible to see in FIG. 3 that the thick cylindrical part 14 of the body supports, to the rear of cover 16, a part carrying the shaft of a pinion 46, the shaft of a hand wheel 48 and appropriate (not shown) bevel pinions for controlling the rotation of pinion 46 during the operation of hand wheel 48. This assembly is arranged in such a way that pinion 46 automatically meshes in rack 44*a* of the actuating rod associated with one of the cavities 26, when the latter is aligned with opening 18.

As has been stated hereinbefore, each of the actuating rods 44 is hollow, which makes it possible to introduce along the axis of the corresponding cavity a central pull handle 50 (FIG. 1) for controlling the locking of the corresponding gripping head 42 on the part to be gripped. Therefore, gripping head 42 has at least one and preferably three movable fingers 52, which are arranged radially in passages arranged at 120° from one another in the gripping head. These passages issue both into a bore 54 extending the central bore formed in the corresponding actuating rod 44 and in a slot 56 formed on the outer face of piston 42. As a result of this arrangement, it is clear that the introduction of the tapering end 50*a* of the pull rod 50 into bore 54 has the effect of radially outwardly displacing fingers 52, in such a way that the latter project into slot 56. In this position, it will subsequently be shown that the part to be discharged can be fixed to the gripping head 42.

In order to bring about a progressive, controlled displacement of pull handle 50 within actuating rod 44, the said handle preferably has in the vicinity of its tapering end 50*a*, a threaded portion 50*b* which is screwed into an appropriate tapping formed in the corresponding gripping head. Thus, it is merely necessary to control the rotation of pull handle 50 with the aid of an appropriate mechanism, such as a crank handle 50*c* (FIG. 4) to lock or unlock the gripping head with respect to a corresponding part.

As is illustrated in FIG. 1, the confinement of the interior of each of the cavities 26 with respect to the contaminated atmosphere which can be introduced into the cavity when a contaminated part is grasped by the gripping head 42, is firstly brought about by means of a scraper joint 58. The latter is supported by the gripping head, so as to be in contact with the interior of the corresponding cavity, no matter what the position of the gripping head in said cavity. However, as it is intended to reuse cylinder 24 a large number of times (e.g. 1000 times), it is clear that the efficiency of the scraper joint 58 soon becomes inadequate. Therefore, each of the gripping heads 42 is also connected to cover 16 by a sealing bellows 60 surrounding that part of actuating rod 44 located within the cavity.

Figure 3:
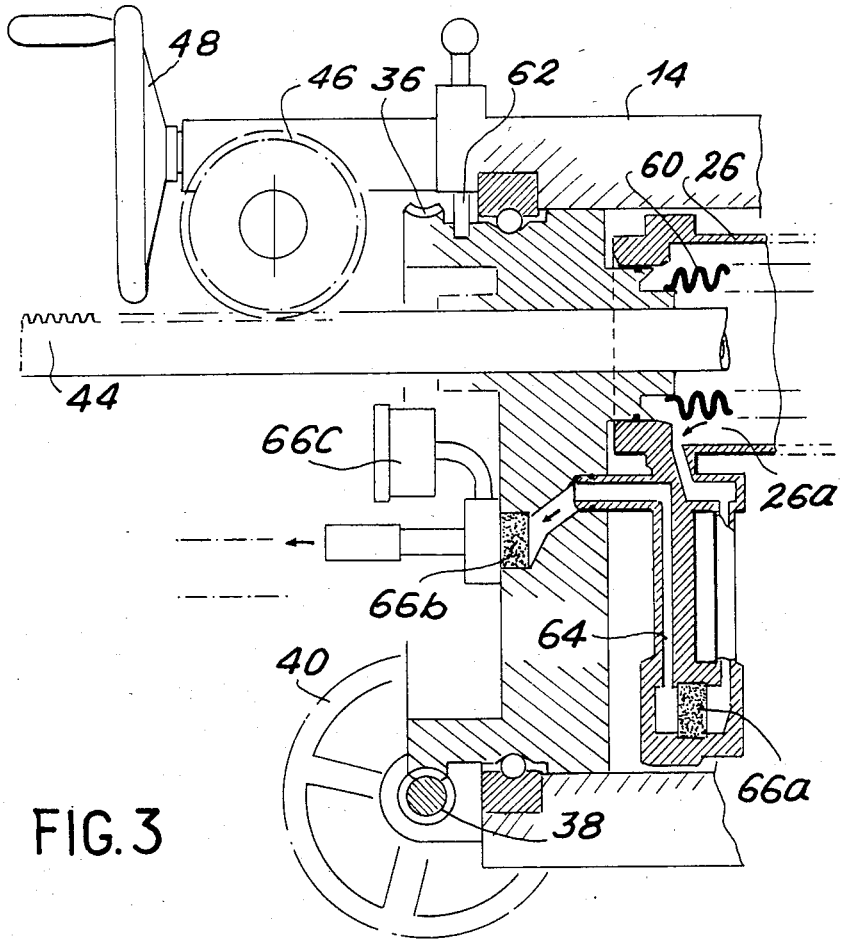
FIG. 3 is a side view in partial section of the rear end of the movable enclosure, more particularly showing the means for controlling the actuating rods and for the rotation of the cylinder, as well as part of the balancing and pumping circuits.

As is more particularly illustrated in FIG. 3, a device such as a spring-operated stop member 62 is mounted on part 14 of the movable enclosure body, so as to maintain the cylinder 24 - cover 16 assembly in position when a cavity 26 faces opening 18. This device ensures that cylinder 24 is not accidentally rotated, when a transfer operation through opening 18 is taking place.

FIG. 3 also shows part of a pumping circuit having ducts such as 64 connecting the internal volume 26*a* of each cavity surrounding the external bellows 60 through the three filters 66*a*, 66*b* and 66*c*.

This pumping circuit has a common part with the pressure balancing circuit, which incorporates a duct connecting opening 18 in the vicinity of its outer orifice to each of the volumes 26*a* through filter 66*a*.

A description will now be given with reference to FIGS. 4 to 6 of the application of the aforementioned movable enclosure to the replacement of an ejector forming part of the treatment or processing circuit of radioactive products.

Figure 4:
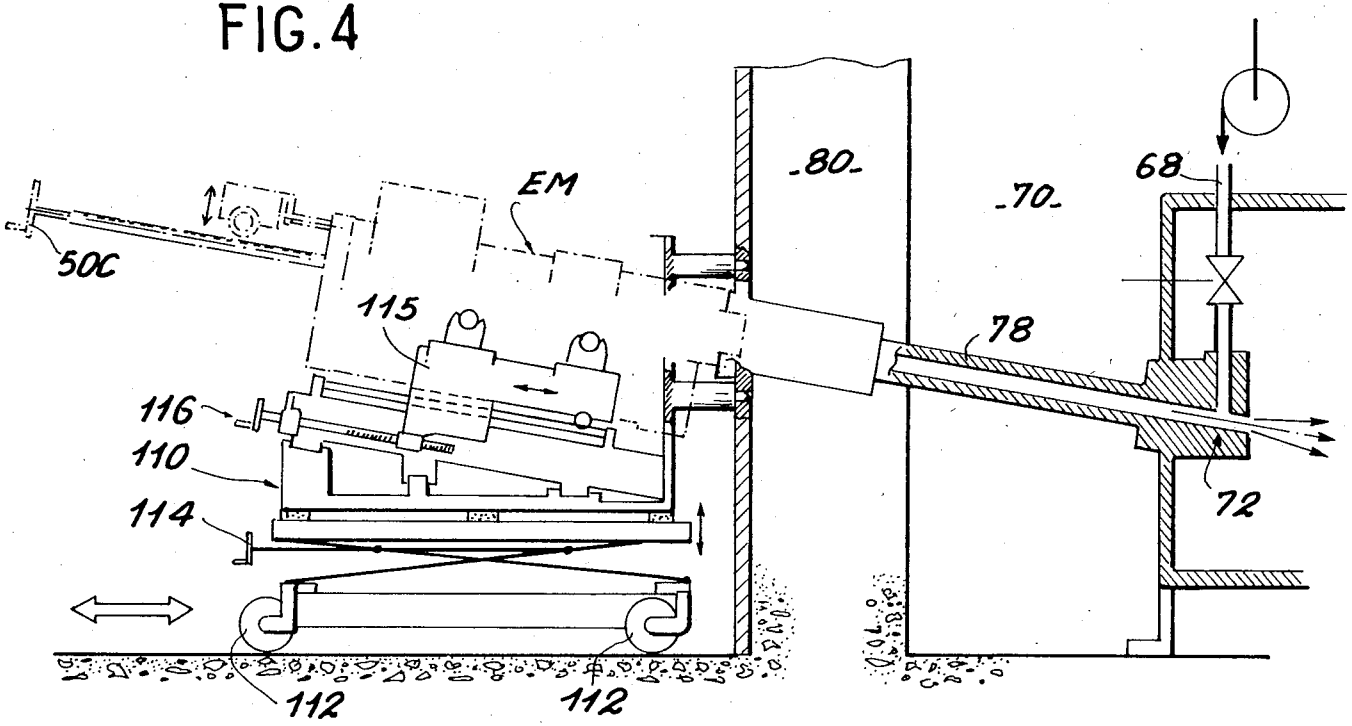
FIG. 4 is a side view diagrammatically showing the installation of the movable enclosure according to the invention on a positioning trolley and illustrating the application of said enclosure to the replacement of the nozzle of an ejector within the confinement cell.

Thus, FIG. 4 shows part of a circuit 68 located within a confinement cell 70, said part incorporating an ejector 72 with a nozzle to be replaced. The shape of nozzle 74 is best shown in FIG. 5*a*. It is joined to a cylindrical nozzle holder 76, which is fitted at 82 onto a cylindrical extension 76*a*. In order to permit their replacement, nozzle 74, nozzle holder 76 and extension 76*a* are located in a bore 78*a* formed in box 78, the latter connecting ejector 72 to the steel-sheathed lead wall 80 of cell 70. More specifically, box 78 is fixed to the outer sheath of wall 80.

As is shown in FIG. 5*a*, extension 76*a* has a part projecting to the outside of wall 80, said part being located during normal operation in an outer box or plug 84 represented in broken line form. This box can be fixed by any known detachable means to any wall 80 and particularly by screws. It has a finger 84*a*, which cooperates with extension 76*a* in order to bring about a correct orientation of nozzle 74.

At wall 80, box 78 has a slot 78*b* which is open towards the outside. A sealing bushing 88 is located in said slot 78*b* and has gaskets 88*a* and 88*b* respectively tightly engaging extension 76*a* and box 78.

As will be shown hereinafter, the dimensions of slot 78*b* correspond to those of the movable enclosure opening 18. More specifically, the entrance of slot 78*b* has a truncated cone shape extending the truncated cone-shaped end of opening 18, the remainder of slot 78*b* being substantially cylindrical.

At its outer end, the bushing 88 also carries a triple action joint 90 complementary to joint 22 located on the movable enclosure around passage 18. In addition to joint 88*b*, joint 90 normally ensures the necessary seal between bushing 88 and box 78. Furthermore, when the movable enclosure is fixed to the cell, it ensures the seal between bushing 88 and the gripping head 42 closing the opening 18. In parallel, joint 22 then ensures the seal between the enclosure body 10 and wall 80.

As is illustrated in FIG. 5*a*, a safety plate 96 is normally fixed between the closure box 84 and box 78, in order to keep bushing 88 in slot 78 and compress joint 90.

When it is wished to replace nozzle 74, the closure box 84 is detached. The safety plate 96 and bushing 88 then remain in place, as can be seen in FIG. 5*a*. A second bushing 92 is then introduced into bushing 88, which for this purpose has a slot 88*c* and the second bushing sealingly cooperates with bushing 88 by means of a gasket 92*a*. This introduction takes place in a controlled manner by means of a locking ring 93 mounted rotatably on bushing 92, but secured thereto for a translation. Ring 93 is screwed into a tapping 86 provided for this purpose at the entrance to slot 88*c*. It is screwed into the tapping by means of a hand wheel 94, to which it is provisionally joined, e.g. by lugs 95.

As is illustrated in FIG. 5*a*, it is important to note that the fitting of bushing 92 in bushing 88 is such that the former does not penetrate to the bottom of slot 88*c*. This enables the fingers 104 located in appropriate openings in bushing 92 to freely project towards the outside, so as to leave free the bore 92*b* in which passes the extension 76*a*.

When these preparatory operations are at an end, the assembly constituted by extension 76*a*, nozzle holder 76 and nozzle 74 is then ready to be extracted from its housing.

Figure 5B:
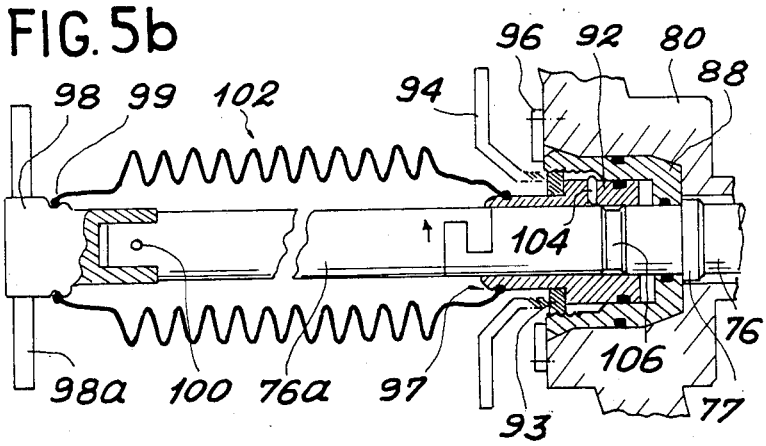
FIGS. 5*a*, 5*b* ad 5*c* show on a larger scale the ejector whose nozzle has to be replaced and illustrate various preparatory stages before the engagement of the movable enclosure, as shown in FIG. 4.

To this end and as illustrated in FIG. 5*b*, a manual extractor 98 provided with a handle 98*a*, e.g. by means of a pin 100, is then fixed to the end of extension 76*a*. Simultaneously, and in order to protect the operator from contamination, between bushing 92 and extractor 98 is fitted a sealing sleeve 102 of a flexible plastic, e.g. polyvinyl chloride. More specifically, the ends of the sealing sleeve 102 are located in grooves 97, 99 provided for this purpose in bushing 92 and extractor 98. It is then possible to pull on the assembly by means of extractor 98, until extension 76*a* is completely removed from its housing. At this instant, a larger diameter part 77 of nozzle holder 76 abuts against bushing 88, as is shown in FIG. 5*b*.

Bushing 92 is then locked onto the nozzle holder 76 by screwing ring 93 right down into the tapping 86 with the aid of hand wheel 94. As is illustrated in FIG. 5*c*, this has the effect of bringing the fingers 104 in front of a reduced diameter part of slot 88*c*, so that these fingers are radially displaced towards the inside and penetrate a groove 106 provided for this purpose in the tip of the nozzle holder 76.

Figure 5C:
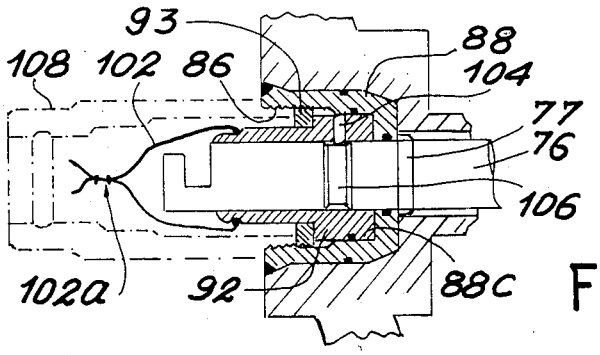
Figure 5A:
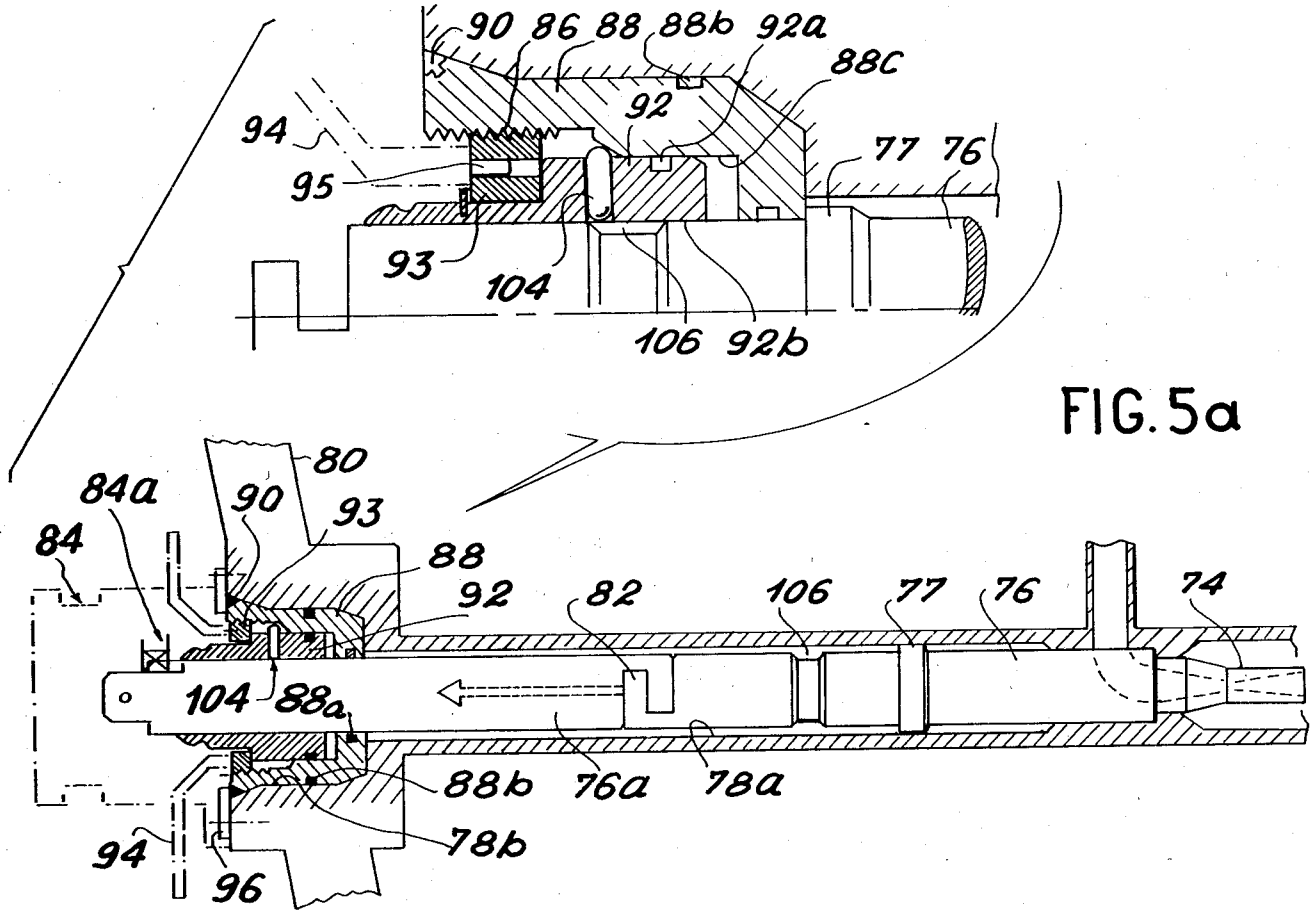

The connection by assembly 82 between extension 76*a* and nozzle holder 76 is then disengaged from its housing, in such a way that extension 76*a* can be disengaged from the nozzle holder 76 and the plastic material sleeve 102 can be welded and then cut at 102*a*, as shown in FIG. 5*c*.

To finish the preparation of the parts prior to the engagement of the movable enclosure, the hand wheel 94 is then removed and a connection sleeve 108 is then fitted, being screwed into tapping 86. The shape of sleeve 108 is determined by the shape of slot 56 formed on the corresponding gripping head 42 of the movable enclosure, so as to subsequently permit the locking together of these two parts.

Following the fitting of sleeve 108, it should be noted that it is merely necessary to pull on this sleeve to extract the assembly formed by nozzle 74 and nozzle holder 76, because bushing 92 is fixed in bushing 88 by ring 93 and bush 92 is itself fixed the nozzle holder 76 by the cooperation of fingers 104 with groove 106. In order to make this movement possible, the safety plate 96 is removed, which has the effect of making bushing 88 mobile relative to wall 80.

In order to bring about the engagement of the movable enclosure EM according to the invention with wall 80 of the cell containing the nozzle to be replaced, FIG. 4 shows that this enclosure is mounted on a trolley 110 having all the appropriate means for carrying out the positioning and orientation of enclosure EM relative to wall 80, in such a way that the opening 18 is located in the extension of slot 78*b* and surface 20*a* tightly bears against the outer face of wall 80.

Thus trolley 110 can more particularly be mounted on rollers or wheels 112, so that it can move up to wall 80 as required. Not shown means make it possible to raise the trolley from the ground when the approach operation is at an end. The positioning can then be carried out with the aid of means 114 making it possible to raise or lower the movable enclosure as required and not shown means make it possible to laterally displace the movable enclosure relative to wall 80. Obviously, these means can comprise any known mechanism making it possible to carry out these functions and particularly by systems of the nut-threaded rod type, which enable precise displacements to be carried out. Means of the same type also make it possible to modify the slope of support 115 on which enclosure EM rests by gravity. Finally, means 116 which are also of the nut-threaded rod type are provided for moving the movable enclosure EM along its axis, following correct orientation and positioning of the enclosure. It should be noted that the enclosure rests by gravity on support 115, so that it can be transported without difficulty and independently of the trolley.

Figure 6:
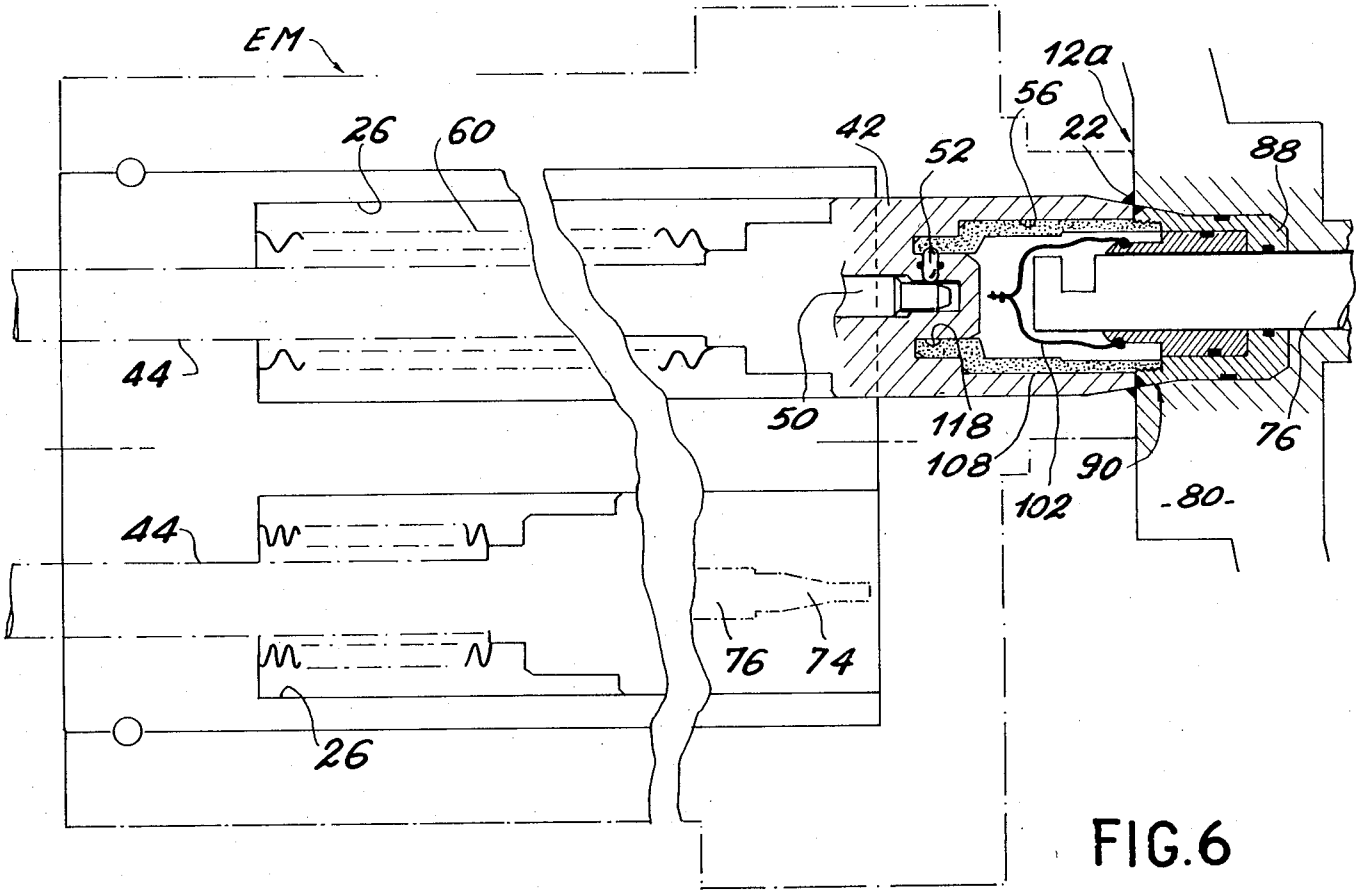
FIG. 6 is a diagrammatic view comparable to FIG. 1 showing how one of the gripping heads can be joined to the ejector to be replaced after the preparatory operations of FIGS. 5*a* to 5*c* have been completed and the engagement of the movable enclosure of FIG. 4 has taken place.

When these various approach, orientation and positioning operations have been carried out with the aid of the means described hereinbefore, the engagement surface 12*a* of the movable enclosure is then in tight contact around passage 18 with the outer surface of wall 80, under the action of the triple action joint 22, as shown in FIG. 6.

At this instant, the gripping head 42 of the corresponding cavity is located in the passage 18 of body 10. Therefore, the end of head 42 is also in tight contact with bushing 88, under the action of the triple action joint 90.

In addition, the connection sleeve 108 is then located within the slot 56 formed in the gripping head 42. More specifically and as illustrated in FIG. 6, sleeve 108 has at its end a groove 118, which then faces the movable fingers 52 of the gripping head.

In order to clock the gripping head on the bushing, it is consequently sufficient to introduce the central pull handle 50 by screwing it into the tapping 50*b* (FIG. 1) provided for this purpose in the gripping head. It is pointed out that this operation can easily be carried out by means of the crank handle 50*c*, provided on its outer end (FIG. 4). When this operation is at an end, FIG. 6 shows that the tip of the pulling handle 50 moves back the fingers 52 into groove 118, in such a way that the gripping head is joined to sleeve 108. In view of the fact that sleeve 108 is itself joined to the nozzle to be extracted, the assembly can then be retracted into the corresponding cavity 26 by acting on the actuating rod 44. Obviously, the dimensions of the cavities are adapted to the dimensions of the parts which the enclosure is to replace.

When this first operation is at an end, the cylinder is rotated by acting on hand wheel 40, so as to bring a second cavity in front of opening 18. This second cavity contains a nozzle 74-nozzle holder 76 assembly which is new, as well as two other bushing 88, 92 and another connection sleeve 108 for connecting the assembly to the gripping head 42 contained in said cavity. When this operation is at an end, the nozzle-nozzle holder assembly is introduced into bore 78*a* of box 78 through opening 18 using the corresponding actuating rod, until bushing 88 abuts in slot 78*b*.

The corresponding gripping head 42 is then unlocked from the connection sleeve 108 associated therewith by removing the corresponding central pull handle 50. The fingers 52 are then no longer held in groove 118 of sleeve 108, so that it is possible to withdraw movable enclosure EM by acting on translation means 116 (FIG. 4).

Following the drawing back of trolley 110 carrying the movable enclosure, the new part is then in the position shown in FIG. 5*c*, with the exception of the sealing sleeve 102, which is not then necessary. The various operations described hereinbefore with reference to FIGS. 5*a* to 5*c* can then be carried out in the reverse order up to the fitting of plug 84 after installing the nozzle.

In the above description, the third cavity has not been used, but it is readily apparent that it could be used for carrying out inspections or certain repairs on the nozzle to be replaced. For example, the first cavity could contain a dummy ejector which would be provisionally fitted prior to the replacement of the nozzle, particularly in order to plug up a duct. It could also contain another new ejector or even an intervention tool, such as an endoscope, pH-meter, etc. Another possible use of the third cavity will be described hereinafter.

It should be noted that when the used ejector replacement operations are at an end, the ejector is located in a cavity displaced relative to opening 18. Moreover, as has been stated, the latter is sealed by the gripping head 42 associated with the cavity facing opening 18. Thus, the environment is perfectly biologically protected. However, if it is feared that this protection is not adequate, it is possible during transportation to close opening 18 by means of a plug 120, as shown in FIG. 1. Preferably, this plug has a part which then penetrates slot 56.

Figure 7A:
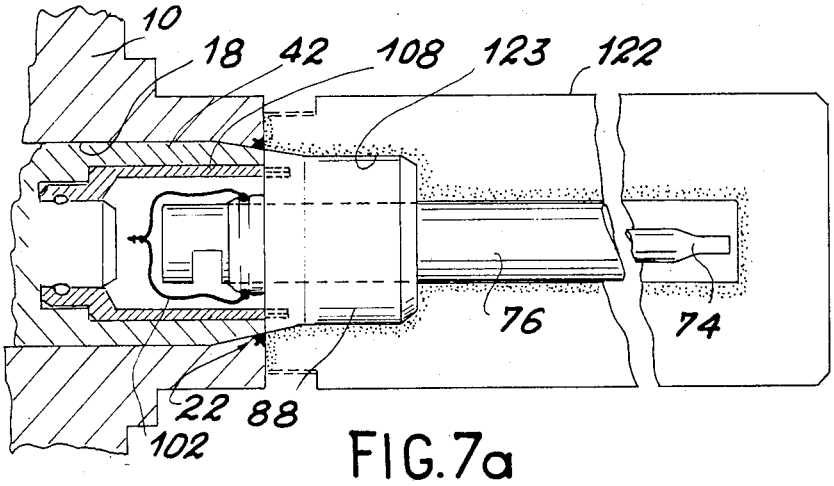
FIGS. 7*a* and 7*b* show respectively, the introduction of the contaminated ejector into a casing or sheath and the sealing of the latter.
Figure 7B:
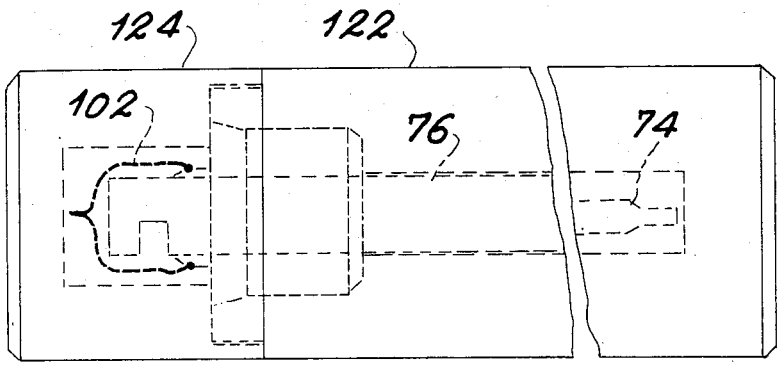

As illustrated in FIGS. 7*a* and 7*b*, when the movable enclosure reaches the discharge unit, its configuration makes it possible, e.g. by using complementary casings 122, not to at any moment break the protection of the environment against the contaminated part. These casings or sheaths are for example made from steel, light alloy or plastic.

Thus, as shown in FIG. 7*a*, such a casing 122 can be positioned facing opening 18 of the enclosure, in such a way that the end of the casing tightly engages with the engagement surface 20*a* of the movable enclosure. The contaminated nozzle-nozzle holder assembly is then introduced into the casing by operations similar to those described hereinbefore and which involve the rotation of cylinder 24 and the actuations of handling rod 44 and the locking pull handle 50. Thus, without difficulty, the position shown in FIG. 7*a* is reached; in which the nozzle 74 and its nozzle holder 76 are within casing 122.

The shape of slot 123 formed in the casing is identical to that of slot 78*b* and the bore 78*a* formed in box 78. Consequently, it is clear that the contaminated parts are all either directly within the casing and isolated from the outside by bushing 88 and 92, or are protected by the plastic bag 102 with respect to the end of the nozzle holder 76 outside the casing.

Thus, casing 122 can be disengaged from the movable enclosure and closed by its cover 124, as shown in FIG. 7*b*, without any break in the confinement.

As a result of these arrangements, it is clear that at no time is there an even partial break in the protection of the environment against the contaminated part.

As has already been stated, the movable enclosure according to the invention is intended for use a large number of times. However, it is clear that cylinder 24 may have to be replaced at the end of a certain number of cycles, which is approximately 1000. Therefore, it is possible to detach body 10 from the movable enclosure enabling the cylinder 24 to be replaced.

Figure 8:
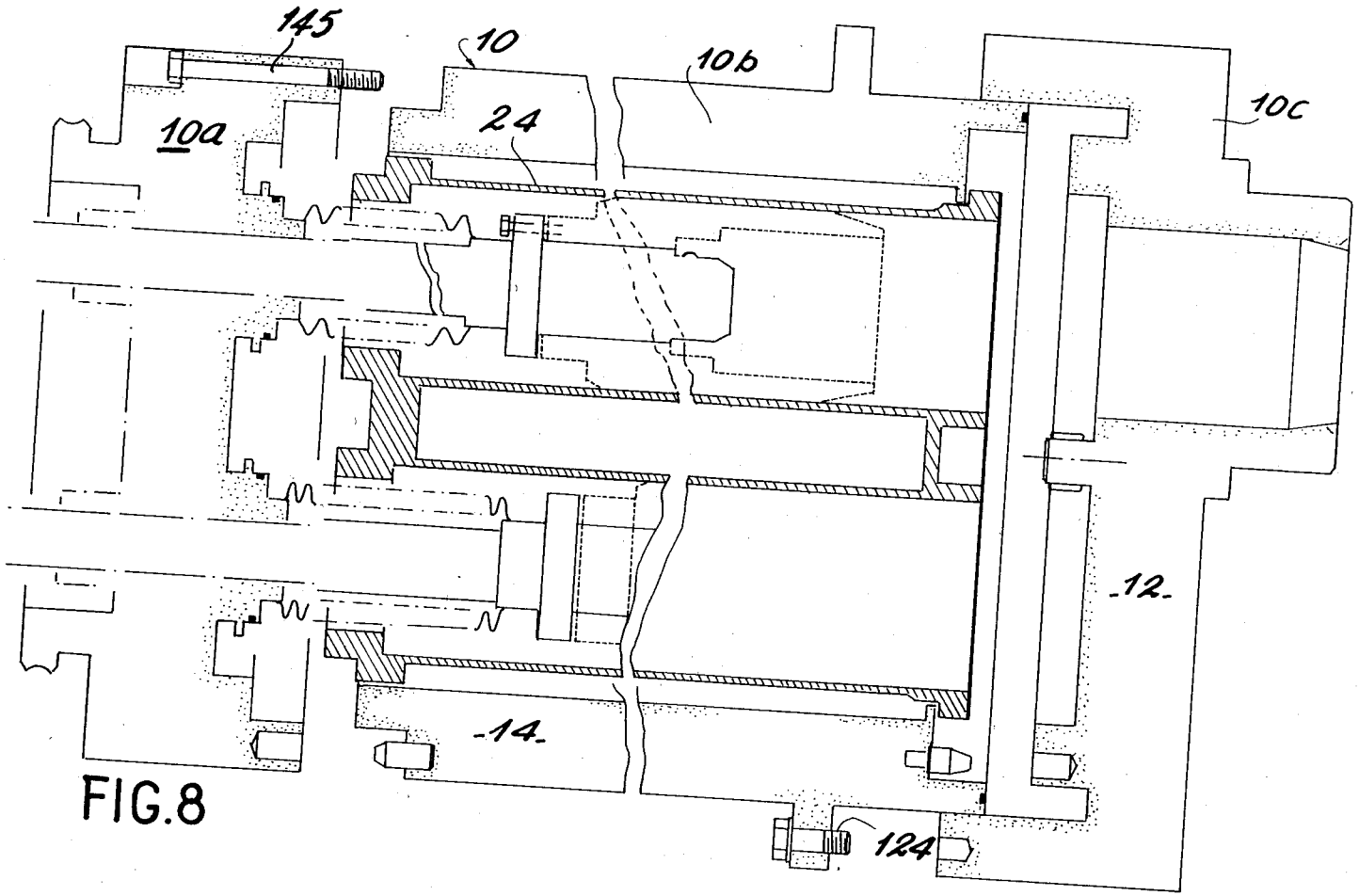
FIG. 8 is a view comparable to FIG. 1 showing the movable enclosure during disassembly, when it is necessary to replace the cylinder.

It is shown in FIG. 8, that the body 10 of the enclosure comprises three detachable parts normally fixed together in a tight manner. Thus, body 10 firstly comprises a rear part 10*a*, which is essentially constituted by cover 16 and the corresponding end of tubular part 14.

This first part 10*a* is fixed by screws 145 to a second part 10*b*, which is substantially identified with the remainder of the cylindrical part 14 of the body. The second part 10*b* is fixed by screws 124 to a third part 10*c* of the body, which essentially corresponds to base 12.

When the two parts 10*a*, 10*b* of the body are dismantled, it is clear that cylinder 24 can be removed and replaced, only the third part 10*c* remaining in place.

Figure 9:
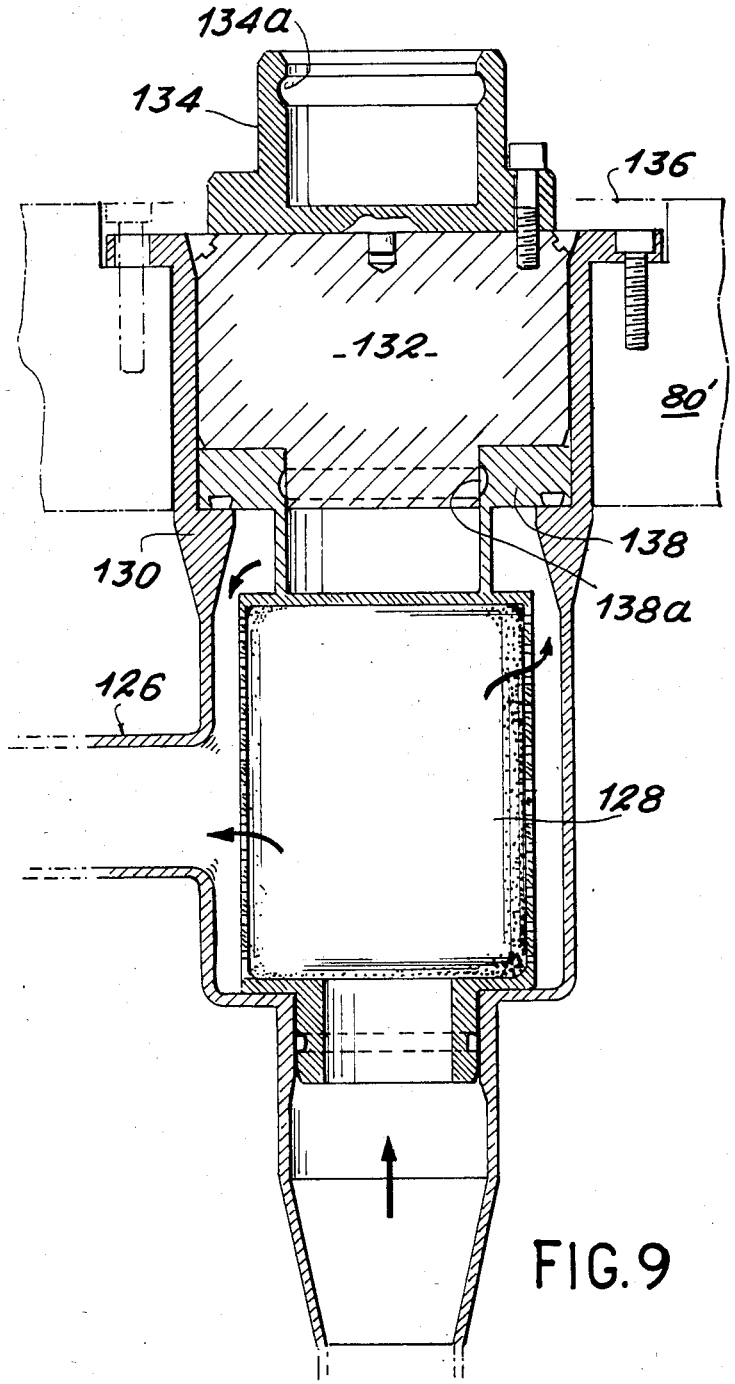
FIG. 9 is a sectional view of part of a circuit operating in a contaminated medium and incorporating a filter, which is to be replaced with the aid of the movable enclosure according to the invention.

In order to illustrate as a variant another possible application of the movable enclosure according to the invention, FIG. 9 shows part of a circuit 126 in which a radioactive fluid is circulating. This circuit more particularly comprises a filter 128, which has to be periodically replaced.

As illustrated in FIG. 9, filter 128 is located in a part 130 connecting circuit 126 to the partition 80' of the confinement cell containing the circuit. At wall 80*a*, the seal is preserved by means of a plug 132, which must be replaced at the same time as the filter.

According to the invention, the movable enclosure EM makes it possible both to retain plug 132 and replace filter 128 during the same intervention. Therefore, FIG. 9 shows that it is merely necessary to fix to plug 132 a connecting bushing 134 provided with a groove 134*a* permitting its gripping with the aid of a gripping head comparable to the aforementioned heads 42. Obviously, the fitting of bushing 134 takes place following the dismantling of cover 136, which normally maintains in place the assembly formed by plug 132 and filter 128.

Figure 10:
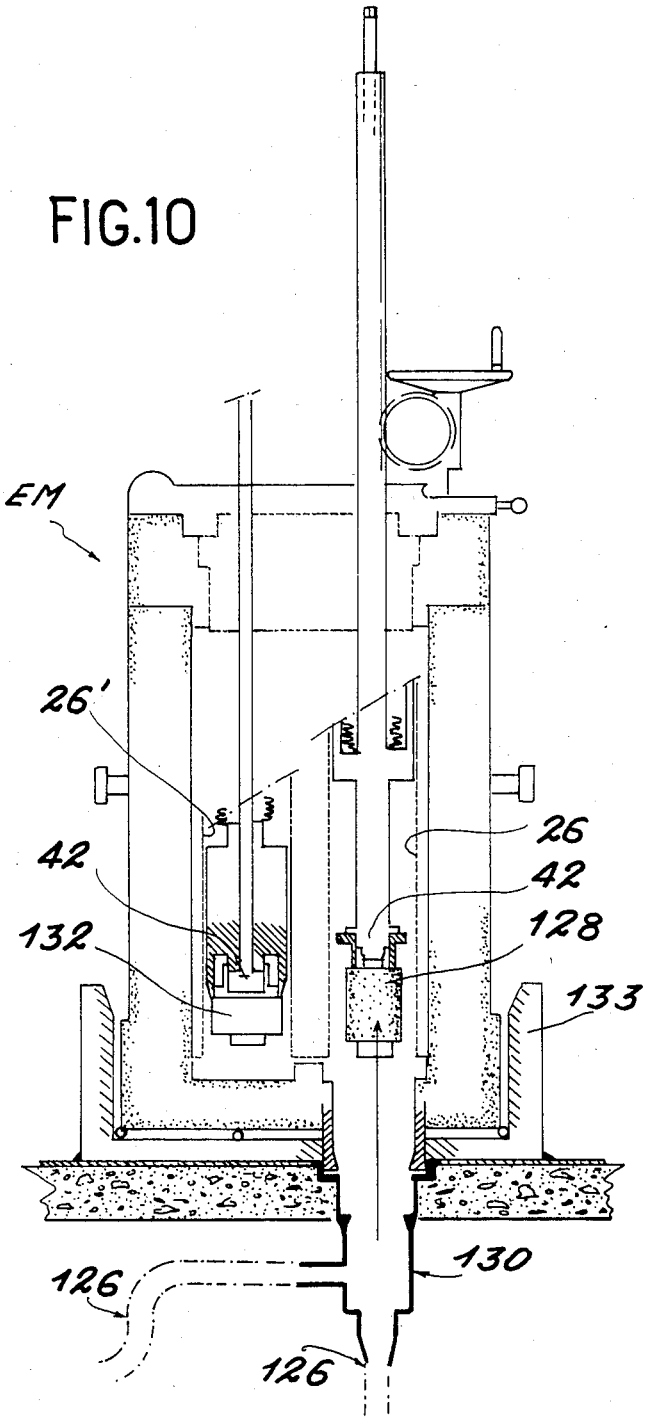
FIG. 10 is a diagrammatic longitudinal sectional view illustrating as a variant the replacement of the filter according to FIG. 9 using the movable enclosure according to the invention.

As illustrated in FIG. 10, it is then possible to fit movable enclosure EM, e.g. by using a centering support 133. When engagement is correctly performed, the seal is maintained by the triple joint 22 and a first cavity 26*a* is brought in front of opening 18. This cavity contains a gripping head 42', adapted to the shape of bushing 134 fixed to plug 132. The latter is then grasped and introduced into cavity 26*a*, in a comparable manner to that described hereinbefore for the nozzle-nozzle holder assembly.

The rotation of cylinder 24 is then controlled so as to bring in front of opening 18 a cavity 26 containing a gripping head 42 adapted to the gripping of filter 128. For this purpose, FIG. 9 shows that filter 128 is integral with a part 138, which is provided with a groove 138*a* ensuring its gripping by means of head 42. Filter 128 which is to be replaced is then introduced into the cavity 26, as illustrated in FIG. 10.

After a further rotation of cylinder 24, a cavity containing a new filter is brought in front of opening 18 and the latter is fitted by operations of the type described hereinbefore. Following a further rotation of cylinder 24, it is clear that it is then easily possible by bringing cavity 26' in front of opening 18, to refit plug 132 on the new filter 128.

Obviously, the invention is not limited to the embodiments described hereinbefore and numerous variants are possible thereto. Thus, it would be possible to construct the gripping head in two parts, whereof one would remain in the opening of the body during the transportation, whereas the other would be brought within a cavity under the action of the corresponding actuating rod. The connection between these two parts of the gripping head could be controlled simultaneously with the engagement of the head on the part to be changed by means of a central pull handle controlling the radial displacement of a series of fingers located in the first part of the gripping head. In this case, the third cavity can be replaced by a plug, which is applied to the first part of the gripping head located in the opening following rotation of the cylinder. It is clear that this solution is less satisfactory because it leads to a more complex mechanical construction, because it requires a supplementary rotation of the cylinder before transportation and because it leads to the elimination of the third cavity which, as has been stated hereinbefore, is indispensable in certain cases.

What is claimed is:

1. Apparatus for replacing and transporting contaminated parts, comprising a mobile body having front and rear ends and providing an enclosure for biological protection, said apparatus being characterized by:

A. a drum in said body which is rotatable about a rotation axis extending through the body and which defines at least two cylindrical cavities, respectively adapted to receive a contaminated part to be replaced and a new replacement part, said cavities having their axes parallel to said rotation axis and spaced at equal distances therefrom;

B. means for rotating said drum within the body so as to bring each of said cavities in turn into alignment with an opening in the front of the body;

C. a gripping head for each cavity, each said gripping head comprising (1) a piston that is slidable axially in its cavity between a rear equipment storage position and a forward position in which the gripping head penetrates said opening, and (2) gripping means carried by said piston for movement relative thereto between defined gripping and releasing positions;

D. said body comprising (1) a cylindrical portion which surrounds said drum, (2) a rear cover which is rotatably sealed to said cylindrical portion and is confined to rotation with said drum relative to said cylindrical portion, and (3) a front base which is fixed to said cylindrical portion and in which said opening is formed;

E. an actuating rod for each gripping head, each said actuating rod being secured to the piston of its gripping head and extending coaxially rearwardly therefrom slidably through and beyond said cover to have a rear portion which projects behind said cover;

F. first actuating means cooperable with said rear portion of each actuating rod for imparting lengthwise motion thereto, for actuating the gripping head aligned with said opening between its said positions; and G. second actuating means receivable in an axially extending bore in each of said actuating rods for actuating said gripping means on each gripping head from one to the other of its said positions.

2. The apparatus of claim 1 wherein said drum has a third cavity.

3. The apparatus of claim 1 wherein said cover and said cylindrical portion are so formed and arranged that said drum can be axially withdrawn from said cylindrical portion upon detachment of said cover therefrom.

4. The apparatus of claim 1, further characterized by:

a sealing bellows surrounding each said actuating rod, each said bellows being connected with said cover and with the piston secured to the actuating rod that it surrounds.

5. The apparatus of claim 1 wherein said bore in each actuating rod opens to the rear end thereof, wherein said gripping means on each gripping head comprises at least one finger which is slidable substantially radially relative to the piston between said defined positions, and wherein said second actuating means comprises a central rod which is insertable into said bore and which has a front end portion formed for camming engagement with an end portion of said at least one finger.

6. The apparatus of claim 5 wherein said central rod has a threaded portion near its front end that can be screwed into a mating internal thread in a gripping head, and has means at its rear end whereby it can be rotated.

7. The apparatus of claim 5 wherein each gripping head is of such size and shape as to tightly close said opening in the body in its said forward position.

8. The apparatus of claim 1, further characterized by:

(1) each said actuating rod having a lengthwise extending toothed rack formed thereon; and (2) said first actuating means comprising (a) a pinion carried by said cylindrical portion of the body and confined to rotation relative thereto, said pinion being in a position to have meshing engagement with the rack formed on the actuating rod secured to the piston aligned with said opening, and (b) means for rotating said pinion.

* * * * *